US006545602B2

(12) United States Patent
Yamaguchi et al.

(10) Patent No.: US 6,545,602 B2
(45) Date of Patent: Apr. 8, 2003

(54) FIRE ALARM SYSTEM

(75) Inventors: Yasuo Yamaguchi, Chiyoda-ku (JP); Makoto Sakihara, Chiyoda-ku (JP); Kouichi Hishino, Chiyoda-ku (JP); Takahiro Oki, Chiyoda-ku (JP); Munehiro Onji, Chiyoda-ku (JP)

(73) Assignee: Nohmi Bosai Ltd., Tokyo (JP)

( * ) Notice: Subject to any disclaimer, the term of this patent is extended or adjusted under 35 U.S.C. 154(b) by 0 days.

(21) Appl. No.: 09/983,266

(22) Filed: Oct. 23, 2001

(65) Prior Publication Data

US 2002/0053972 A1 May 9, 2002

(30) Foreign Application Priority Data

Oct. 25, 2000 (JP) ..... 2000-325200
Dec. 5, 2000 (JP) ..... 2000-370775

(51) Int. Cl.[7] ..... G08B 1/00
(52) U.S. Cl. ..... 340/531; 340/514; 340/517; 340/506; 340/538; 340/533; 340/535
(58) Field of Search ..... 340/506, 514, 340/517, 507, 508, 531, 533, 539, 538

(56) References Cited

U.S. PATENT DOCUMENTS 5,293,155 A * 3/1994 Nicol et al. ..... 340/506
5,379,023 A * 1/1995 Dalton ..... 340/568
5,400,246 A * 3/1995 Wilson et al. ..... 340/825.36 X
5,406,254 A * 4/1995 Le Nay et al. ..... 340/501
5,525,962 A * 6/1996 Tice ..... 340/506
5,559,492 A * 9/1996 Stewart et al. ..... 340/331
5,705,979 A * 1/1998 Fierro et al. ..... 340/517
6,313,744 B1 * 11/2001 Capowski et al. ..... 340/514

* cited by examiner

*Primary Examiner*—Daryl Pope
(74) *Attorney, Agent, or Firm*—Wenderoth, Lind & Ponack, L.L.P.

(57) ABSTRACT

A fire alarm system provided with a fire receiver (1) to which a plurality of fire sensors and controlled apparatuses are connected. The fire receiver (1) comprises a LAN interface (11) for connecting with other fire receivers. When a fire sensor issues an alarm, the fire receiver transmits the fire information over the LAN together with a group number set in advance, and displays (12) only the fire information of the same group number when the fire receiver receives fire information transmitted from the other fire receivers via the LAN. Thus, even is a plurality of fire receivers are used in a large building divided into ridge sections, fire information can be shared without causing disorder.

9 Claims, 8 Drawing Sheets

FIG. 2

| | ZONE SETTING (MAXIMUM NUMBER IS SEVEN) | | | | | |
|---|---|---|---|---|---|---|
| | 1 | 2 | 3 | 4 | 5 | 6 |
| AD 1 | Z 1 | Z 12 | IP 1 | | | |
| AD 2 | Z 1 | | | | | |
| AD 3 | Z 1 | | | | | |
| AD 4 | ··· | | | | | |
| : | | | | | | |
| AD 14 | ··· | | | | | |
| AD 15 | Z 7 | IP 2 | | | | |
| AD 16 | Z 7 | IP 2 | | | | |
| AD 17 | Z 7 | IP 2 | | | | |
| AD 18 | ··· | | | | | |
| : | | | | | | |
| AD 44 | ··· | | | | | |
| AD 45 | Z 12 | IP 1 | | | | |
| AD 46 | ··· | | | | | |
| AD 47 | ··· | | | | | |
| : | | | | | | |

FIRE ALARM SYSTEM

BACKGROUND OF THE INVENTION

1. Field of the Invention

The present invention relates to a fire alarm system.

2. Description of the Related Art

Conventionally, in a fire alarm system consisting of fire receivers connected to each other by a LAN, fire detection information of fire receivers is shared between each of the fire receivers connected by the LAN.

In addition, in the conventional fire alarm system, as a plurality of terminal apparatuses connected to a fire receiver, controlled apparatuses such as area sound apparatuses and smoke preventing and exhausting apparatuses which operate in correspondence with an issue of an alarm of a fire sensor that detect a fire are connected to the same fire receiver. The linkage therebetween is made by the unit of a receiver.

In addition, a fire alarm system is configured such that a plurality of fire receivers are connected by a LAN (Local Area Network), respectively, and share data by exchanging data signals (hereinafter referred to simply as signals). In this case, there are two ways in which a signal is transmitted. One is the case in which a fire receiver transmits a signal to another fire receiver. The other is the case in which a fire receiver transmits a signal to all the other fire receivers connected to the LAN, which is a so-called global transmission. The global transmission will be specifically described in this specification. When a fire receiver carries out the global transmission, the other fire receivers transmit response data signals (hereinafter referred to as response signals) in order to indicate that a signal of the global transmission has been accurately received.

FIGS. 9*a* to 9*c* illustrate conventional signals that are transmitted over a LAN. A description will be made assuming that five fire receivers are connected to the LAN in FIGS. 9*a* to 9*c*. FIG. 9*a* shows that each fire receiver independently transmits a response signal to a fire receiver #1 in response to a global fire signal that is transmitted by the fire receiver #1 designating all the other fire receivers as destinations of transmission. In this case, five signals (one fire signal and four response signals) are transmitted over the LAN. FIG. 9*b* shows that the fire receiver #1 transmits a global fire signal and then a fire receiver #2 also transmits a global fire signal. Here, a fire signal is given priority over a response signal. Thus, the tire signal is transmitted by the fire receiver #2 before all the fire receivers finish transmitting response signals in response to the fire signal transmitted by the fire receiver #1. Then, since there is not specifically any order of priority for each response signal, response signals responding to the fire signal transmitted by the fire receiver #2 may be transmitted earlier than response signals responding to the fire signal transmitted by the fire receiver #1. In this case, ten signals (two fire signals and eight response signals) are transmitted over the LAN. FIG. 9*c* shows that each fire receiver transmits a response signal in response to each global fire signal transmitted by each of the five fire receivers. In this context, for simplicity of a description, each response signal is transmitted to the LAN in good order. However, since there is not specifically any order of priority for each response signal actually as described above, each response signal may not be transmitted in good order. In this case, twenty-five signals (five fire signals and twenty response signals) are transmitted over the LAN.

In addition, a repeater of the conventional fire alarm system cannot cause controlled apparatuses such as area sound apparatuses and smoke preventing and exhausting apparatuses to be driven by a power source superimposed over a signal line from a fire receiver. Therefore, the repeater receives an activation signal transmitted by a fire receiver, causes a relay to operate based on the activation signal and supplies an external power to the controlled apparatuses, thereby activating the controlled apparatuses.

In addition, the repeater of the conventional fire alarm system is provided with a disconnection monitoring circuit or the like in order to detect disconnection of a control line to which the controlled apparatuses are connected. For example, in the disconnection monitoring circuit, resistors are connected in parallel on the controlled apparatus side, a micro-current is always flown to the control line and disconnection is detected according to a variation of the current, whereby disconnection of the control line is monitored.

However, in recent years, since buildings have become larger and more complicated, if a building is divided into two ridge sections, for example, it is sufficient to monitor a fire in each ridge section in many cases when a plurality of fire receivers are installed to configure a fire alarm system. Thus, since fire detection information is shared by all fire receivers connected to a LAN in the conventional fire alarm system, for example, an occurrence of a fire in one ridge section may be notified to the other ridge section and the other ridge section where a fire has not occurred is carelessly disordered.

In addition, as buildings become larger, it is likely that controlled apparatuses such as smoke exhausting outlets and smoke exhausting fans and a series of fire doors are connected to different fire receivers. However, in the conventional fire alarm system, since the linkage of the controlled apparatuses to an issue of an alarm of a fire sensor is made by the unit of a fire receiver, the controlled apparatuses cannot operate in correspondence with the issue of the alarm by the fire sensors among different fire receivers.

In addition, here, it is assumed that, for example, sixty-four fire receivers are connected to each other by a LAN. When one fire receiver transmits a global fire signal, the remaining sixty-three fire receivers transmit response signals responding to the fire signal (the total number of signals is sixty-four). subsequently, when another fire receiver transmits a global fire signal, the remaining sixty-three fire receivers also transmit response signals. In this way, if all the fire receivers transmit fire signals one after another, the total of 4096 (=64×64) signals are exchanged over the LAN. Actually, when an alarm is sounded to warn a fire, it is normally for an area where an issue of an alarm is required but all alarms may be sounded all at once if necessary. In this case, a state of signals over the LAN is the same as the above-mentioned state.

Each fire receiver is set such that a signal of fire information is given priority over other signals in transmission even among such a large volume of signals. However, if a large volume of signals is transmitted, since it is highly likely that signals collide with each other over the LAN and data is collapsed, re-transmission processing of signals is required. In addition, processing after receiving the signals is complicated. Due to such useless signals, a fire receiver satisfying a processing capacity that allows for a worst result is required.

In addition, the repeater of the conventional fire alarm system causes the relay to operate, thereby supplying an external power to controlled apparatuses to activate the controlled apparatuses. However, operation of a relay contact is not detected because it is assumed that the contact normally operates when the relay is caused to operates Thus, if the relay contact is not in operation in spite of the fact that the relay is caused to operate, there is a problem where it is likely that controlled apparatuses are not actually activated in a state in which a fire receiver determines that the controlled apparatuses are activated.

Therefore, it is possible to confirm operation of the relay by separately providing a circuit for confirming operation of a relay and using the circuit to monitor a variation of a voltage or the like on the controlled apparatus side at the time when the relay is caused to operate. However, this makes the circuit of the repeater complicate and increases the number of components of the repeater.

In addition, a power source superimposed over a signal line from a fire receiver is used as an operation power source of each circuit including that for driving the relay in the repeater. When high and low of a voltage are repeated by a transmission signal transmitted through the signal line, there is a problem where, if the relay is caused to operate in the low state, the relay may not respond because a voltage level for causing the relay to operate is too low.

SUMMARY OF THE INVENTION

The present invention has been devised in order to solve such problems, and it is an object of the present invention to provide a fire alarm system with which information can be shared among a plurality of fire receivers, which are connected to each other by a LAN, for each unit of a group of fire receivers, and controlled apparatuses can operate in accordance with an issue of an alarm by a fire sensor among different fire receivers.

In addition, it is an object of the present invention to provide a fire alarm system that can reduce the number of signals to be exchanged over a LAN as far as possible.

Further, it is an object of the present invention to provide a repeater that can detect operation of a relay contact by a simple circuit without increasing the number of components thereof.

A fire receiver according to the present invention is provided with, in a fire receiver to which a plurality of fire sensors and controlled apparatuses, which is controlled in correspondence with an issue of an alarm of the fire sensor, are connected, an interface for LAN access for connecting to other fire receivers by a LAN, means for, when the fire sensors issue an alarm, transmitting the fire information together with a group number set in advance over the LAN, and means for, upon receiving fire information transmitted from other fire receivers via the LAN, displaying only the fire information of the same group number.

Further, a fire receiver according to the present invention is provided with means for, when a special group number is set as a group number, displaying all pieces of fire information upon receiving the fire information transmitted from the other fire receivers via the LAN.

Further, in a fire receiver according to the present invention, a special group number can be set as a group number and the fire receiver is provided with means for displaying fire information upon receiving the fire information transmitted from fire receivers of the special group number via the LAN.

Further, a fire receiver according to the present invention is provided with, in a fire receiver to which a plurality of fire sensors and controlled apparatuses, which is controlled in accordance with an issue of an alarm of the fire sensor, are connected, an interface for LAN access for connecting to other fire receivers by a LAN, storing means in which information on interlocking relation between the fire sensors and the controlled apparatuses as well as interlocking relation between the fire sensors and controlled apparatuses of other fire receivers is stored, means for, when the fire sensors issue an alarm, outputting activation information of controlled apparatuses to be interlocked, and transmitting activation information to the other fire receivers over the LAN at the same time based on the information stored in the storing means, and means for activating controlled apparatuses designated by the activation information upon receiving the activation information transmitted from the other fire receivers via the LAN.

Further, a fire receiver according to the present invention is provided with, in a fire receiver to which a plurality of fire sensors and controlled apparatuses, which is controlled in accordance with an issue of an alarm of the fire sensors, are connected, an interface for LAN access for connecting to other fire receivers by a LAN, storing means in which zone information set for each of the fire sensors and the controlled apparatuses and common zone information to controlled apparatuses of the other fire receivers are stored, means for, when the fire sensors issue an alarm, outputting activation information of controlled apparatuses to be interlocked in an identical zone, and transmitting the common zone information over the LAN at the same time based on the zone information stored in the storing means, and means for activating controlled apparatuses of an identical common zone based on the zone information stored in the storing means upon receiving the common zone information transmitted from the other fire receivers via the LAN.

Other objects and features of the present invention will be apparent from the following descriptions taken in conjunction with the accompanying drawings, in which like reference characters designate the same or similar parts throughout the figures thereof.

BRIEF DESCRIPTION OF THE DRAWINGS

In the accompanying drawings:

FIG. 2 illustrates an interlocking table;

DESCRIPTION OF THE PREFERRED EMBODIMENTS

Figure 1:
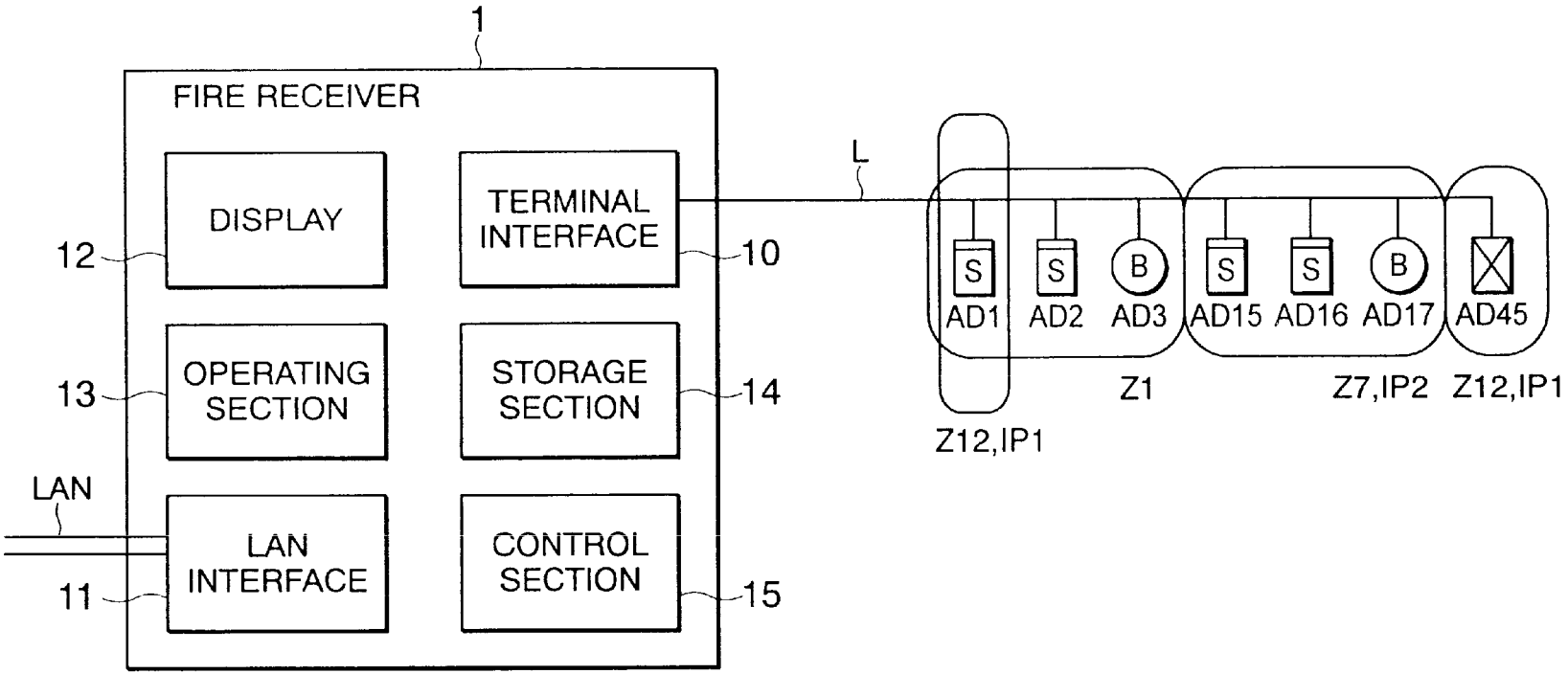
FIG. 1 is a block diagram showing a configuration of a fire receiver in accordance with an embodiment of the present invention.

Embodiments of the present invention will be hereinafter described with reference to the drawings.

First, an outline of the present invention will be described.

The present invention is a fire alarm system in which a plurality of fire receivers that monitor and control a plurality of terminal apparatuses (fire sensors and controlled apparatuses such as area sound apparatuses and smoke preventing and exhausting apparatuses) are connected by a Local Area Network (LAN) and installed, wherein the fire receivers existing on an identical LAN are given group numbers, respectively, and wherein each fire receiver operates to share information only within an identical group.

Moreover, a certain special group can be set as a group number. A fire receiver that is granted a special group status captures any information of each fire receiver that is connected to an identical LAN regardless of a group number.

Consequently, even if buildings have become large and complicated; a facility is configured by installing a plurality of fire receivers; and a building is divided into ridge sections, the fire receivers can be easily classified by giving a group number to each fire receiver such that the receivers can be distinguished for each ridge section.

In addition, the same is true for the case in which owners sectionally own a building, and the owners can share information within the owner's share.

In addition, even in a building divided into ridge sections, a control center is provided to monitor fire information collectively. Although each ridge section does not need fire information of other ridge sections, any fire information needs to be collected in the control center. However, a fire receiver cannot be installed in the control center if the fire receiver functions for sharing fire information only among fire receivers within a group number. Thus, in this case, a certain special group is set to make centralized monitoring of the entire building possible.

The present invention is a fire alarm system in which a plurality of fire receivers that monitor and control a plurality of terminal apparatuses (fire sensors or controlled apparatuses such as area sound apparatuses and smoke preventing and exhausting apparatuses) are connected by a Local Area Network (LAN) and installed, wherein the fire alarm system activates controlled apparatuses within zones of an identical fire receiver, which is set in the fire receivers, at the time of an issue of an alarm by a fire sensor and, at the same time, spreads information of a common zone, which is set in the fire sensors that issued the alarm, over the LAN; and wherein the other fire receivers recognize the common zone as activation information from the information on the LAN and activate the controlled apparatuses set in their own common zones Consequently, even if buildings become large and controlled apparatuses such as smoke exhausting outlets and smoke exhausting fans and a series of fire doors are connected to different fire receivers, a common zone number for controlling an apparatus connected to a fire receiver different from a pertinent fire receiver is added to a setting with respect to controlled apparatuses that interlock at the time of an issue of an alarm by a fire sensor, the pertinent fire receiver transmits the common zone number as information over the LAN and all the fire receivers connected to the LAN receive the common zone number as information, whereby each fire receiver can activate the controlled apparatuses in which the common zone number is set.

In this case, even if there are many apparatuses that are activated through the LAN, since the apparatuses can be activated simply by spreading the common zone number as information over the LAN, the fire alarm system is simple and easy to operate.

Next, details of this embodiment will be described.

FIG. 1 is a block diagram showing a configuration of a fire receiver in accordance with an embodiment of the present invention.

In the figure, reference numeral 1 denotes a fire receiver main body, 10 denotes a terminal interface to which a plurality of terminal apparatuses such as fire sensors and controlled apparatuses are connected via a signal line L, 11 denotes a LAN interface for connecting the fire receiver with other fire receivers, 12 denotes a display, 13 denotes an operating section, 14 denotes a storage section for storing various kinds of setting information including a receiver number, a group number and an interlocking table to be described later and 15 denotes a control section for controlling the entire fire receiver.

In addition, reference character AD indicates addresses (AD1, AD2 . . . ) set in each terminal. In FIG. 1, reference characters AD1, AD2, AD15 and AD16 denote fire sensors, AD3 and AD17 denote area sound apparatuses and AD45 denotes a smoke preventing and exhausting apparatus. The area sound apparatuses and the smoke preventing and exhausting apparatus are controlled apparatuses.

In addition, although seven terminal apparatuses are connected to the fire receiver 1 in FIG. 1, for example, maximum of 510 terminal apparatuses can be connected to the fire receiver 1.

In addition, each terminal apparatus is classified into a group according to a zone. For example, the terminal apparatuses of the addresses AD1, AD2 and AD3 belong to a zone 1 (Z1), the terminal apparatuses of the addresses AD15, AD16 and AD17 belong to a zone 7 (Z7) and the terminal apparatus of the address AD45 belongs to a zone 12 (Z12). The terminal apparatuses in each zone are interlocked with each other.

In addition, A12 is set for the terminal apparatus of AD1 as a zone for interlocking. When the fire sensor of AD1 issues an alarm, the terminal apparatus of Z12 is interlocked with it.

For example, when the fire sensor of AD1 issues an alarm, since Z1 and Z12 are set as interlocking data of AD1, the fire receiver 1 controls activation of the terminal apparatus of Z1 and the terminal apparatus of Z12, whereby an area sound apparatus of AD3 and a smoke preventing and exhausting apparatus of AD45 are activated and area sounding and smoke preventing and exhausting control are carried out.

In addition, each terminal apparatus can set a common zone (IP zone) as a zone for being interlocked with terminal apparatuses connected to other fire receivers. For example, a zone IP1 is set for the terminal apparatus of AD45 in Z12 and a zone IP2 is set for the terminal apparatus of AD15, AD16 and AD17 in Z7.

Then, the setting of these zones is stored in the storage section 14 as, for example, data of an interlocking table as shown in FIG. 2.

This interlocking table is set, for example, by being inputted by the control section 13 or transferred from an external personal computer or the like.

Figure 3:
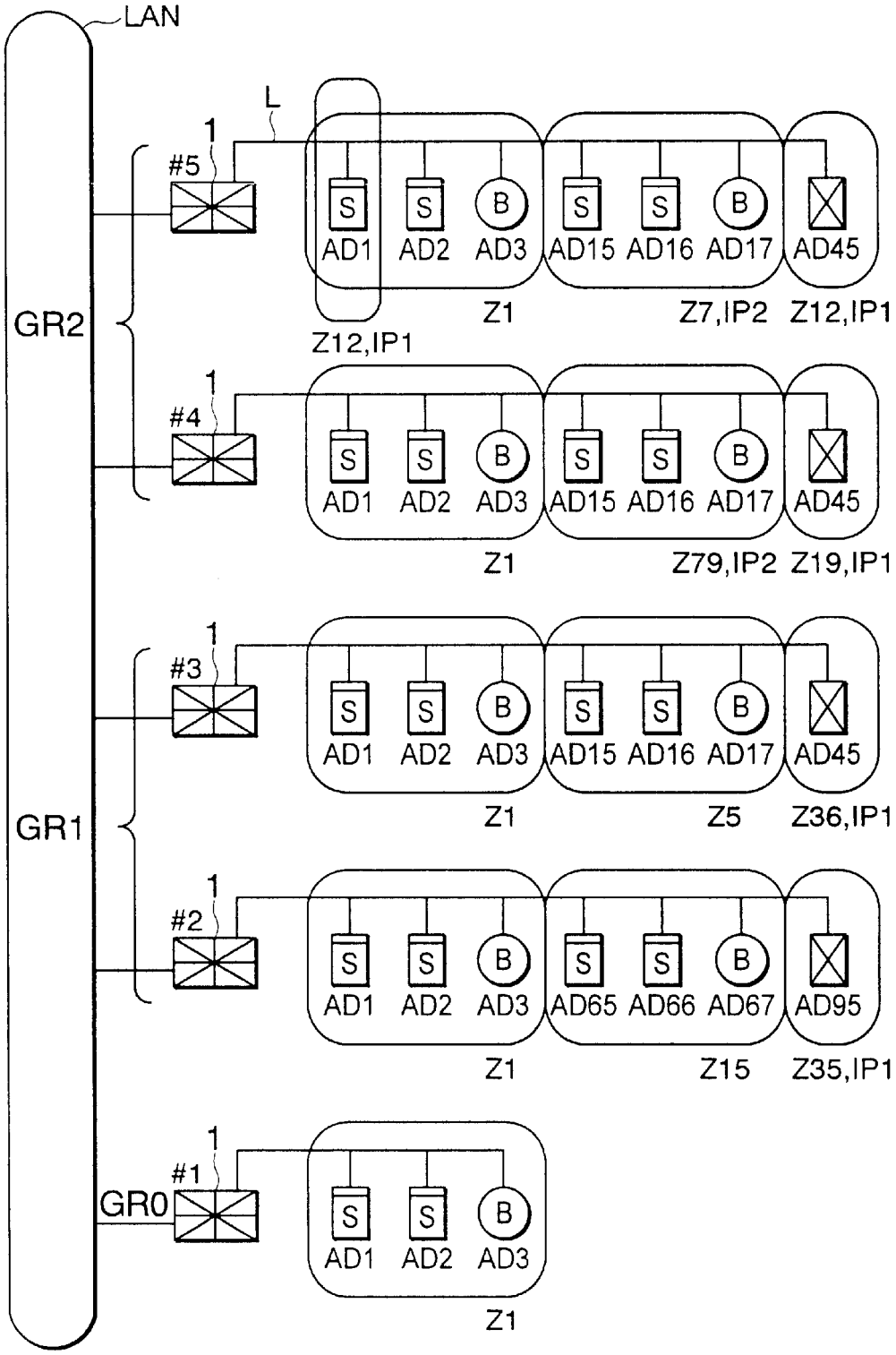
FIG. 3 illustrates a configuration of a fire alarm system in accordance with the embodiment.

Then, the fire receivers as shown in FIG. 1 are connected by a LAN as shown in FIG. 3 to form a fire alarm system.

In FIG. 3, the fire receiver of FIG. 1 corresponds to a fire receiver #5. A configuration of fire receivers #1 to #4 is the same as that of the fire receiver of FIG. 1 except the setting of addresses of terminal apparatuses and various zones.

In addition, the LAN is, for example, a LAN using an RS485 standard and, as shown in FIG. 3, may connect the fire receivers 1 in a loop shape or may simply connect the fire receivers 1 without making a loop.

In addition, it is possible to classify the fire receivers 1 connected to the LAN into groups by setting group numbers. group 1 (GR1) is set for the fire receivers #2 and #3, and group 2 (GR2) is set for the fire receivers #4 and #5. Moreover, group 0 (GR0) as a special group is set for the fire receiver #1.

Note that #1 to #5 given to the fire receivers 1 are receiver numbers for distinguishing each other over the LAN.

Next, operations of this embodiment will be described.

First, when the fire sensor of AD1 of the fire receiver 1 #5 issues an alarm, the fire receiver 1 #5 outputs the information to the LAN together with a group number.

Then, each of the other fire receivers displays, for example, "#5-AD1 Fire" on the display 12 of a fire receiver in the same group as the fire receiver 1 #5, that is, in this case, the fire receiver #4 of GR2 based on information from the fire receiver 1 #5 on the LAN.

At this point, since the fire receivers 1 #2 and #3 belong to the group GR1, which is a different group from the fire receiver 1 #5, the fire receivers 1 #2 and #3 do not show the indication on the display 12.

In addition, the fire receiver 1 #1 for which GR0 is set operates as a special fire receiver for accepting all groups of information that it receives without discrimination and displays "#5-AD1 Fire" as well.

Further, although each fire receiver 1 outputs fire information to the LAN together with a group number to determine whether it is necessary or not to display information that it receives based on a group number of the information, a receiver number may be used in stead of the group number. That is, a receiver number of a fire receiver belonging to the same group is set for each fire receiver 1 instead of a group number, and fire information with a receiver number (having a receiver number in the information) is outputted to the LAN, whereby each fire receiver 1 may determine a receiver number from the information that it receives and, if it is the receiver number set for it, display the information. In this case, each fire receiver 1 does not need to use a group number when outputting information to the LAN. Each fire receiver 1 can determine whether it is necessary to display information or not using a receiver number that is necessary as fire information.

Then, an interlocking operation of each terminal apparatus is controlled by, for example, the interlocking table as shown in FIG. 2, that is stored in the storage section 14 in the fire receiver 1 to which it is connected. Each fire receiver 1 recognizes a group of each terminal apparatus by the interlocking table and carries out interlocking control among the terminal apparatuses.

For example, when a fire sensor of AD1 of the fire receiver 1 #5 issues an alarm, since Z1 and Z12 are set as interlocking data of AD1 as shown in FIG. 2, the fire receiver 1 controls activation of the terminal apparatuses in Z1 and the terminal apparatus in Z12 via the signal line L, whereby the area sound apparatus of AD3 and the smoke preventing and exhausting apparatuses of AD45 are activated, and area sounding and smoke preventing and exhausting control is carried out. As shown in FIG. 2, a zone is set for an address of each terminal apparatus, an area of an apparatus that issued an alarm and an area of an apparatus to be activated are not required to be identically arranged. In addition, the zones Z1, . . . other than the IP zone are set for each fire receiver 1 and do not have a function of being interlocked with different receivers.

In addition, interlocking information among fire receivers is set as the IP zone in the interlocking table of each fire receiver 1. In FIG. 2, IP1 is set for the fire sensor of AD1 of the fire receiver #5; IP 1 is set for the smoke preventing and exhausting apparatus of AD45; and IP2 is set for the area of Z7 in the same manner.

For example, when smoke preventing and exhausting apparatuses are fire doors, in order to activate all the fire doors all at once, IP1 is set for each of the fire doors #2-AD95, #3-AD35, #4-AD45 and #5-AD45. When the fire sensor of AD1 of the fire receiver 1 #5 issues an alarm, the fire receiver 1 #5 controls activation of its own terminal apparatuses in Z1 and Z12 via the signal line L, whereby the area sound apparatus of AD3 and the smoke preventing and exhausting apparatus of AD45 are activated as described above and, at the same time, activation information of IP1 is transmitted over the LAN.

Then, when each fire receiver 1 connected to the LAN receives the activation information of IP1, since each fire receiver controls the linkage of the apparatuses of IP1, the fire receiver 1 #2 activates the smoke preventing and exhausting apparatus of AD95 for which IP1 is set; and in the same manner, the fire receiver 1 #3 activates the smoke preventing and exhausting apparatus of AD35 for which IP1 is set; and the fire receiver 1 #4 activates the smoke preventing and exhausting apparatus of AD45 for which IP1 is set.

Further, the fire preventing and exhausting apparatuses, for which IP1 is set, that are activated as described above are required to be restored after the fire is brought under control. Each terminal apparatus are collectively restored in the area of GR2 by a restoration operation, which is not described in detail, applied to the fire receiver 1 #5. Then, the fire receiver 1 #5 transmits information about the restoration of IP1 over the LAN based on this restoration operation. Then, each fire receiver 1 responds to it as in the case of activation and can restore the activated smoke preventing and exhausting apparatuses, respectively.

Moreover, if the issue of restoration or the like is taken into account, a fire receiver belonging to a different group can indicate that the fire receiver carried out activation control according to an IP zone when it did so. In this case, since smoke preventing and exhausting apparatuses are activated, it is preferable to display its cause and activated contents in terms of a state indication of a system in each fire receiver because the state and the indication coincide with each other. Then, since they are shown on the display of the fire receivers, the smoke preventing and exhausting apparatuses can be restored independently even if the fire receiver that is the cause of the activation does not carry out a restoration operation.

Such interlocking according to zone setting among the fire receivers is used for functions of not only the smoke preventing and exhausting apparatuses but also the area sound apparatuses. For example, when it is intended to sound in Z7 of the fire receiver 1 #5 by the issue of an alarm in Z79 of the fire receiver 1 #4, IP2 is set for the fire receiver 1 #5 as in Z7. Then, the fire receiver 1 #4 outputs activation information of IP2 over the LAN according to the issue of an alarm in Z79 of the fire receiver 1 #4 and the receiver 1 #5 controls activation of the terminal apparatus of AD17 set, by the activation information of IP2.

As shown in FIG. 2, since the P1 zone is set for the address of each terminal apparatus in the same manner as the zones Z1, . . . , the zone of each fire receiver 1 and the IP zone are not required to be identical.

In addition, since the IP zone for interlocking among the fire receivers can be set for each fire receiver, and an outputting side and an inputting side of the IP zone can also be set independently, management is easy even if there is a change or the like.

Further, information of a zone for interlocking set in each fire receiver 1 may be set in each terminal apparatus together with the IP zone. That is, for example, if the case of the activation of a fire door that is already described is taken as an example, Z12 and IP1 are set as zones for the fire sensor of AD1 and fire door of AD45 of the fire receiver 1 #5. Then, the fire receiver 1 #5 outputs Z12 via the signal line L by the issue of an alarm of the fire sensor of AD1 and determines that the fire door of AD45 itself belongs to its own zone to activate the fire door and, at the same time, outputs IP1 to the LAN. When receiving IP1 from the LAN, each fire receiver 1 outputs IP1 to each signal line L and each of the fire doors AD95 of #2, AD35 of #3 and AD45 of #4, for which IP 1 is set as a terminal apparatus of each fire receiver 1, receives IP1 and is activated.

In the above-mentioned embodiment, there is an advantage in that data for interlocking is collectively set in the storage section 14. In this case, according to a variation of this embodiment, since information for interlocking is not required to be set in each fire receiver 1, there is an advantage in that a capacity of the storage section 14 can be reduced and time and labor of the control section 15 for designating an address from the IP zone can be reduced.

In this embodiment, in a fire alarm system in which a plurality of fire receivers are connected by a LAN, each fire receiver is classified into a group and fire information is shared only among the group. Thus, even if a plurality of fire receivers are used in a large building that is divided into ridge sections, it becomes possible to share fire information without causing disorder. In addition, since a fire receiver, which is set as belonging to a special group, shares fire information from all the fire receivers, it becomes possible to easily carry out centralized monitoring.

In addition, zone setting in fire receivers with respect to addresses of terminal apparatuses and an IP zone, which is common among different fire receivers, are stored in each fire receivers as an interlocking table. A fire receiver applies processing of interlocking operations in the zones of the fire receiver in response to an issue of an alarm of a fire sensor based on the information of the interlocking table and, at the same time, transmits activation information of the IP zone over the LAN to cause terminal apparatuses of the identical IP zone connected to the other fire receivers. Thus, interlocking of controlled apparatuses with an issue of an alarm of the fire sensor becomes possible among different fire receivers.

Further, although seven zones can be set with respect to an address of each terminal apparatus as shown in FIG. 2 in this embodiment, seven or more zones may be set.

In addition, although a LAN is configured with a LAN using the RS485 standard in this embodiment, any LAN may be used as long as each fire receiver can receive information from other fire receivers and transmit same information to all the other fire receivers over the LAN.

In addition, as another embodiment different from the above, a different special group will be described, assuming that a receiver number and a group number of each fire receiver 1 connected to a LAN are identical. In the above-mentioned embodiment, GR0 is a special group for accepting all groups of information that it receives as a special group via the LAN without discrimination. To the contrary, in this another embodiment, GR0 is a special group that is accepted by all groups as information to be received via the LAN.

Operations in the case in which GR0 is another special group will be described, In FIG. 3, when a fire sensor of AD1 of the fire receiver 1 #1 issues an alarm, for example, the fire receiver 1 #1 outputs the information to the LAN together with GR0. Then, each of the other fire receivers displays, for example, "#1-AD1 Fire" on the displays 12 of all the fire receivers 1 based on the information transmitted from the fire receiver 1 #1 over the LAN. In this case, the fire receivers 1 #2 to #5 belong to different groups and if the GR0 is an ordinary groups, the indication is not shown. However, if it is a special group, the indication is shown on the displays 12 as in the case of the same group.

It may be desired that such operations are shared by an entire building concerning, for example, fire information in a main part of a facility such as an electric facility and an elevator facility even in a building that is divided into ridge sections. In this case, a special group can be set in a fire receiver that monitors a specific area, whereby it is made possible to cause all fire receivers to display fire information outputted from the fire receivers of the special group via a LAN. Further, the special group in this another embodiment is allowed to be mixed with the special group in the above-mentioned first embodiment by giving it a number such as 100 that is different from the number 0 to distinguish the former from the latter.

Figure 4:
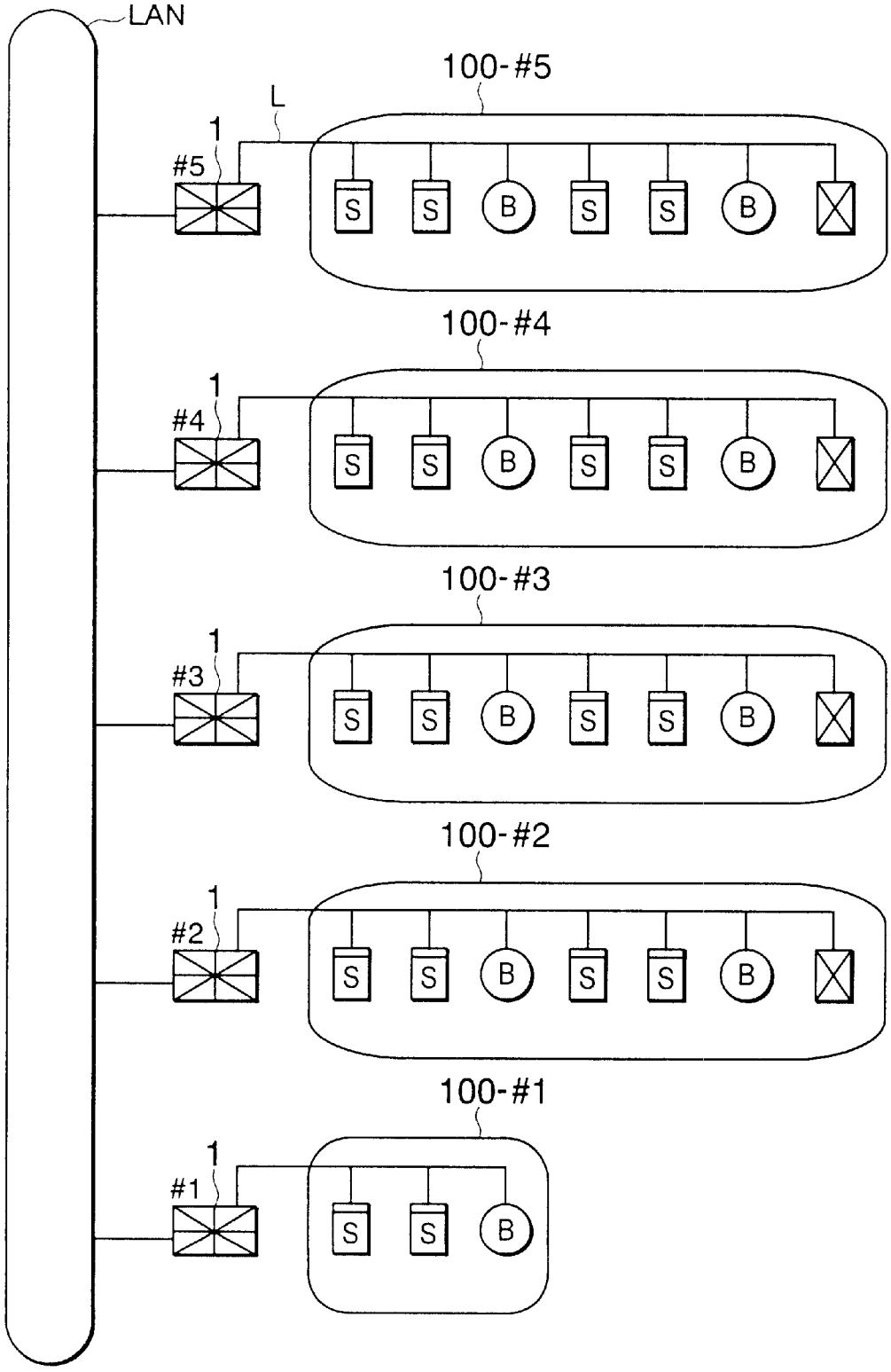
FIG. 4 illustrates a configuration of the fire alarm system in accordance with the embodiment.

FIG. 4 illustrates a configuration of the fire alarm system, wherein the figure is the same as FIG. 3 except that reference numerals of sets of terminal apparatuses are shown. As in FIG. 3, fire receivers 1 #1, #2, #3, #4 and #5 are shown. Each of the fire receivers 1 is connected to an LAN and exchanges data signals with each other via the LAN. Although different numbers are assigned to the fire receivers 1 connected to the LAN, respectively, each fire receivers 1 has an identical configuration. The LAN is based on, for example, the RS485 standard. 100-#1 to 100-#5 are sets of terminal apparatuses connected to the fire receivers 1, respectively. The sets of terminal apparatuses shown in FIG. 4 represent fire sensors (sensors), fire alarms (bells) and smoke preventing and exhausting apparatuses In this embodiment, it is unnecessary to specifically distinguish them from each other.

Conventionally, a response signal is generated independently in response to each fire signal and transmitted. This embodiment is arranged to generate a response signal that is compounded for received fire signals before transmission and then transmit. Although each of the fire receivers 1 #1 to #5 generates a response signal based on a received fire signal, when it receives another fire signal before transmitting the response signal, it abandons the generated response signal and generates a new response signal to transmit it.

Figure 5A:
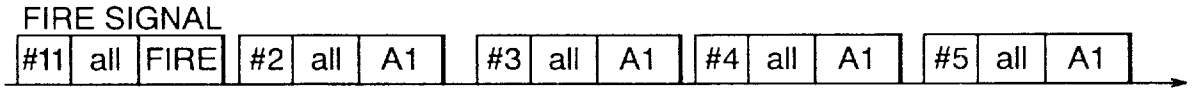
FIGS. 5*a* to 5*c* illustrate signals to be transmitted over a LAN.
Figure 5B:
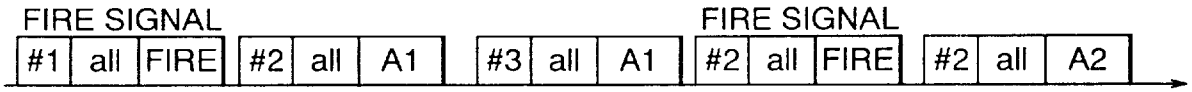
Figure 5C:
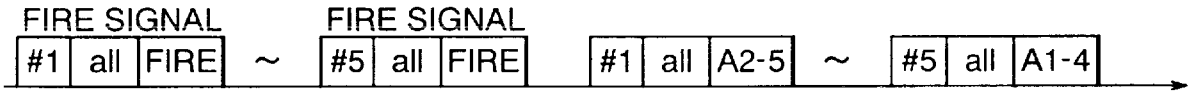
Figure 9A:
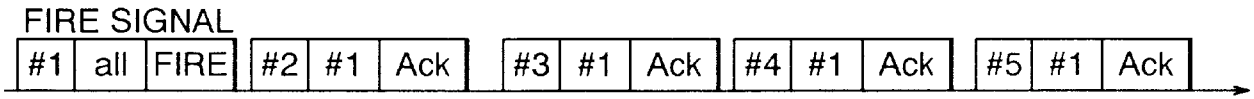
FIGS. 9*a* to 9*c* illustrate conventional signals to be transmitted over a LANE.
Figure 9B:
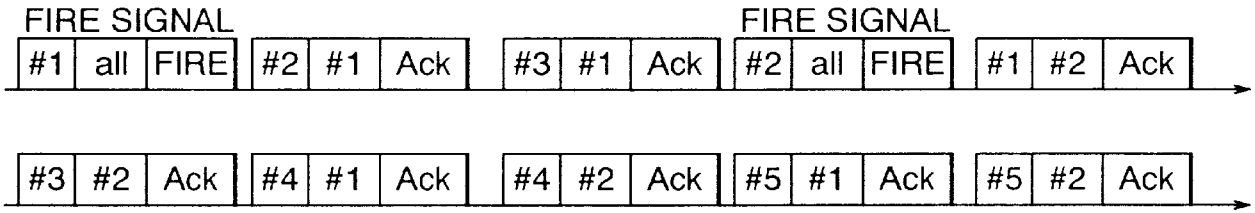
Figure 9C:
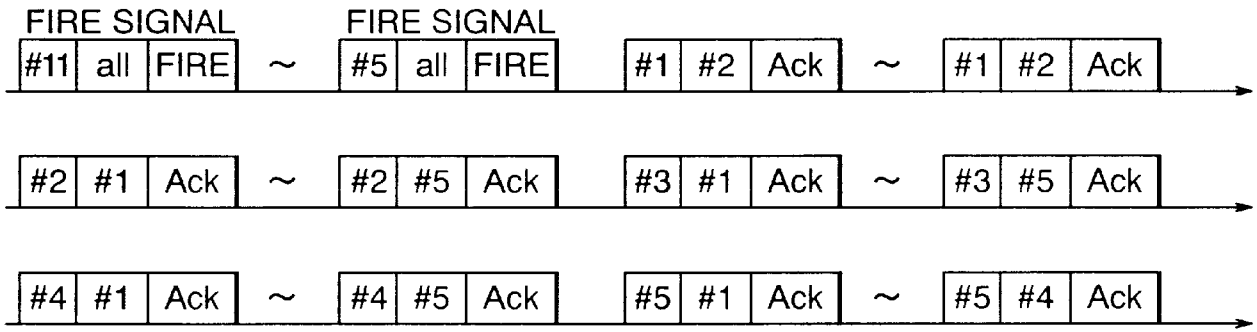

FIGS. 5*a* to 5*c* illustrate signals to be transmitted over a LAN. In FIGS. 5*a* to 5*c*, a timing for each of the fire receivers 1 #1 to #5 to transmit a fire signal is also the same as that in FIGS. 9*a* to 9*c*. In the case as shown in FIG. 5*a*, since only one fire signal is transmitted, five signals (one fire signal and four response signals) are transmitted over the LAN as before. However, although the fire receiver 1 that has transmitted a fire signal is a destination of transmission of a response signal conventionally, a response signal is transmitted to all the fire receivers 1 in this embodiment.

In the case as shown in FIG. 5*b*, before the fire receiver 1 #2 transmitted a fire signal, the fire receiver 1 #2 and the fire receiver 1 #3 transmitted response signals in response to a fire signal transmitted by the fire receiver 1 #1. Thus, only data for responding to the fire receiver 1 #1 is included in those response signals. Even after the fire receiver 1 #2 transmitted a fire signal, since the fire receiver 1 #3 had transmitted a response signal in response to the fire signal transmitted by the fire receiver 1 #1, it transmits a response signal in response to a fire signal transmitted by the fire receiver 1 #2. On the other hand, since the fire receiver 1 #4 and the fire receiver 1 #5 did not transmit response signals in response to the fire signal transmitted by the fire receiver 1 #1 even after the fire receiver 1 #2 transmitted the fire signal, the fire receiver 1 #4 and the fire receiver 1 #5 abandon response signals responding to the fire signal transmitted by the fire receiver 1 #1, generate response signals responding to the fire signals transmitted by the fire receiver 1 #1 and the fire receiver 1 #2 anew and transmits them. Thus, in this case, eight signals (two fire signals and six response signals) are transmitted over the LAN. Further, if a fire signal was transmitted from two fire receivers 1 among the five fire receivers 1, minimum of seven signals (two fire signals and five response signals) are transmitted over the LAN and data of information concerning a transmission source of a signal to which the fire receivers 1 intend to respond is set in the response signals.

The case of FIG. 5*c* shows a minimum number of signals to be transmitted over the LAN in response to a fire signal that the five fire receivers 1 transmitted globally, that is, designating all the fire receivers 1 as destinations. In the minimum case, only the number of response signals corresponding to the number of the fire receivers 1 are transmitted. In the case of FIG. 5*c*, ten signals (five fire signals and five response signals) are transmitted over the LAN.

Upon receiving a fire signal, the fire receiver 1 transmits a response signal and, at the same time, causes fire alarms in the set of terminal apparatuses to operate to sound bells and issues an alarm or the like.

As described above, in this embodiment, each of the fire receivers 1 #1 to #5 transmits a response signal in response to fire signals transmitted from the fire receivers 1 except itself. In this regard, when fire signals are transmitted from a plurality of fire receivers 1, response signals responding to the fire signals are collectively transmitted globally. Thus, the number of signals exchanged over the LAN can be reduced and each fire receiver 1 needs not to carry out complicated processing.

Further, although the example in which the invention is applied to a fire alarm system is described in the above-mentioned embodiment, it is not limited to the fire alarm system but can be applied to, for example, a system utilizing the polling.

Figure 6:
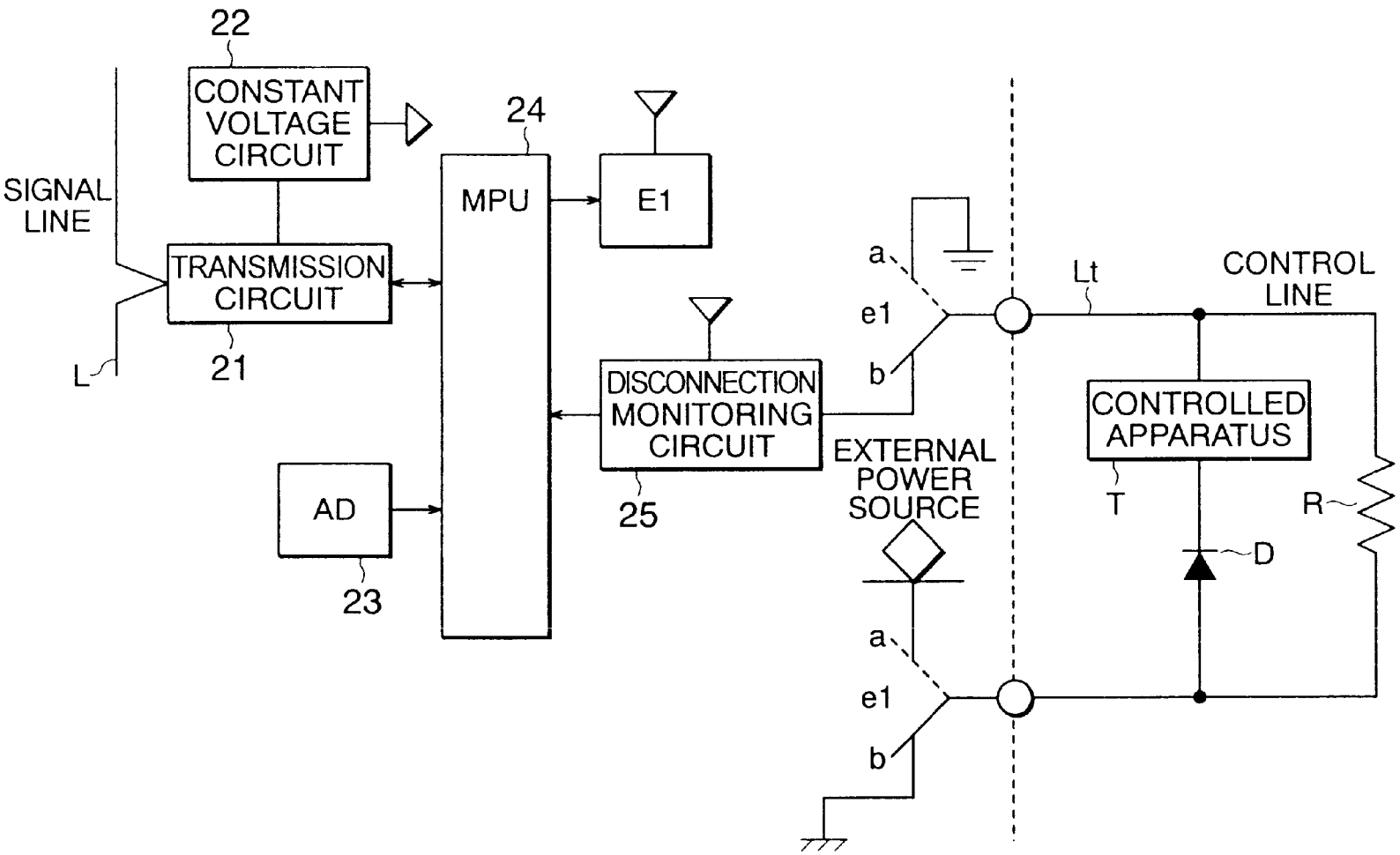
FIG. 6 is a block diagram showing a configuration of a repeater in accordance with the embodiment of the present invention.

FIG. 6 is a block diagram showing a configuration of a repeater that controls activation of controlled apparatuses of a fire alarm system used as the terminal apparatus of FIG. 1 in accordance with the first embodiment of the present invention.

In the figure, reference character L denotes a signal line, which is connected to the fire receiver 1 not shown in FIG. 6 and is connected to a plurality of terminal apparatuses.

Reference numeral 21 denotes a transmission circuit, which is connected to the fire receiver 1 via the signal line L to receive data such as an activation signal and transmit state information or the like.

Reference numeral 22 denotes a constant voltage circuit, which supplies a predetermined voltage to each part in the repeater with a voltage superimposed over the signal line L as a power source.

Reference numeral 23 denotes an address setting unit in which an address or the like of the repeater is set, 24 denotes a control unit (MFU) for controlling operations of the entire repeater, 25 denotes a disconnection monitoring circuit, E1 denotes a relay and e1 denotes replay contacts of the relay E1, respectively. The relay contacts e1 of the relay E1 are connected to the b side when the relay E1 is not operating and to the a side when the relay E1 is operating.

Here, the disconnection monitoring circuit 25 monitors a state of the control line Lt by always flowing a monitoring current to the control line Lt via the relay contacts E1 (in the state of the b side) and detects that the control line Lt is in the disconnected state when the monitoring current stops flowing.

Reference character Lt denotes a control line and T denotes an apparatus that is activated by an external power source supplied to the control line Lt, for example, a controlled apparatus such as a smoke preventing and exhausting apparatus. Further, reference numeral R denotes a terminal resistor.

In this way, the repeater is composed of the transmission circuit 21, the constant voltage circuit 22, the address setting unit 23, the control unit (MPU) 24, the disconnection monitoring circuit 25, the relay E1 and the relay contacts E1 of the relay E1.

Next, operations of this repeater will be described.

First, normal operations of the repeater will be described.

(1) The repeater always exchanges signals with the not-shown fire receiver 1 and returns a response signal in response to a call signal from the fire receiver 1.

(2) Upon receiving an activation signal from the not-shown fire receiver 1, the repeater activates the controlled apparatus T. That is, the control unit 24 of the repeater causes the relay E1 to operate and switch its contacts E1 from the b side to the a side. Then, an external power is supplied to the apparatus T via the control line Lt and the apparatus T is activated.

(3) When the relay contacts E1 are switched, the repeater detects that the disconnection monitoring circuit 25 is in a disconnected state and outputs.

Here, the disconnected state to be detected is not actual disconnection of the control line Lt. The disconnection monitoring circuit 25 detects a disconnected state from the fact that a monitoring current has stopped flowing by the switching of the relay contacts E1 (in the state of the a side) and then make outputs.

(4) The control unit 24 confirms the activation operation. That is, the control unit 24 receives the output form the disconnection monitoring circuit 25 and determines that an output from the disconnection monitoring circuit 25 after an output for activating the relay E1 is an activation confirming output.

Here, the control unit 24 determines the activation confirming output simultaneously with determining that the relay E1 is being controlled. That is, in the case in which the disconnected state continues from the time when the relay E1 has not yet been controlled, the controlled apparatus T is not successfully controlled even if there is an output from the disconnection monitoring circuit 25.

Further, in the state in which the relay E1 is not activated, since the output is an output made during normal disconnection monitoring, it is needless to mention that it is determined as a disconnection detecting output.

Next, operations of the repeater at the time when disconnection occurs will be described.

(1) The disconnection monitoring circuit 25 always flows a monitoring current to the control line Lt via the relay contacts e1 (in the state of the b side).

(2) When the control line Lt is disconnected, the monitoring current stops flowing. Then, the disconnection monitoring circuit 25 detects that the monitoring current is not generated and outputs to the control unit 24.

(3) The control unit 24 recognizes the disconnected state based on the output from the disconnection monitoring circuit 25 in the uncontrolled state of the relay E1 and returns a signal indicating the disconnected state as a response signal in response to a call signal from the fire receiver 1.

At this point, a monitoring current flows only to the control line Lt via the terminal resistor R and does not flow to the controlled apparatus T by a diode D. Therefore, even if a plurality of controlled apparatuses T are controlled by one control line Lt, the disconnection can be detected by the same monitoring current. Further, a capacitor, a Zener diode or the like other than a resistor may be provided as a so-called end-of-line unit of the control line Lt. In addition, a flow of a monitoring current need not to be constant but may be intermittent.

In this way, in this embodiment, the control unit 24 determines that an output of the disconnection monitoring circuit 25 at the time when the relay E1 is operating as an activation confirming output of the relay contacts e1 based on whether there is a control output to the relay E1 and using an output of the disconnection monitoring circuit 25 that monitors disconnection of the control line Lt, whereby operations of the relay contact e1 can be performed and confirmed with a simple circuit configuration and a small number of components.

Further, the control unit 24 may control monitoring of a plurality of circuits assuming that the relay E1, the relay contacts e1, the control line Lt and the disconnection monitoring circuit 25 form one circuit.

Next, operations of this repeater will be described.

First, a form of exchanging signals with the fire receiver 1 will be described.

Figure 7:
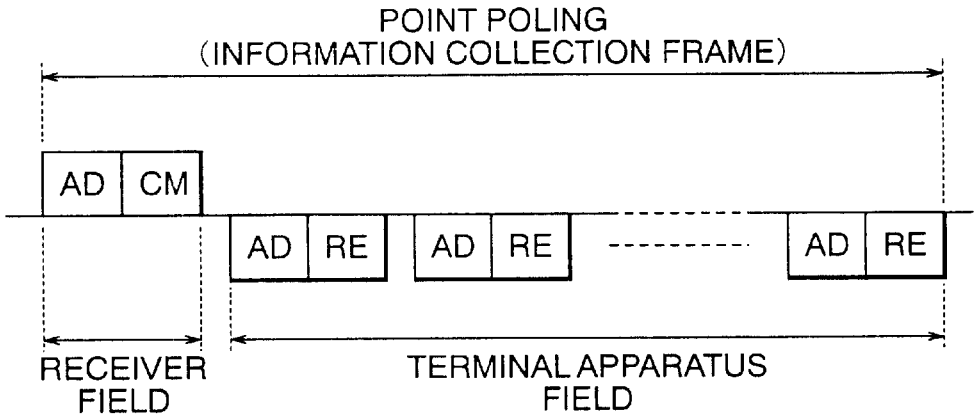
FIG. 7 schematically illustrates a form of a signal for collecting information in transmission between a fire receiver and a terminal apparatus.

FIG. 7 schematically illustrates a form of a signal for collecting information in transmission between the fire receiver 1 and a terminal apparatus.

First, when collecting information from each terminal apparatus, the fire receiver 1 designates a group by point polling and receives responses from a plurality of terminal apparatuses belonging to the group.

Here, a plurality of terminal apparatuses connected to the fire receiver 1 via the signal line L are classified into groups. For example, when up to 255 addresses can be given to the terminal apparatuses, if the addresses are divided into sixteen groups, sixteen or fewer apparatuses belong to one group. Further, each terminal apparatus can calculate in advance a group that it belongs to and its order within that group from its own address.

Then, in a frame of point polling, the fire receiver 1 first designates a group (the position of AD) and combines a call signal (the position of CM) with it to transmit them. This is a receiver field in terms of timing.

In response to this, the terminal apparatuses in the corresponding group sequentially return their addresses (the positions of AD) and state information (the positions of RE). At this point, the terminal apparatuses output independently based on their order in the group such that the responses do not overlap. This is a terminal apparatus field in terms of timing.

The receiver field and the terminal apparatus field are combined to form one transmission frame.

In this way, since a plurality of terminal apparatuses are caused to respond to one call signal, state information of each terminal apparatus can be collected easily.

Next, a timing for activating a controlled apparatus from the repeater will be described.

Figure 8:
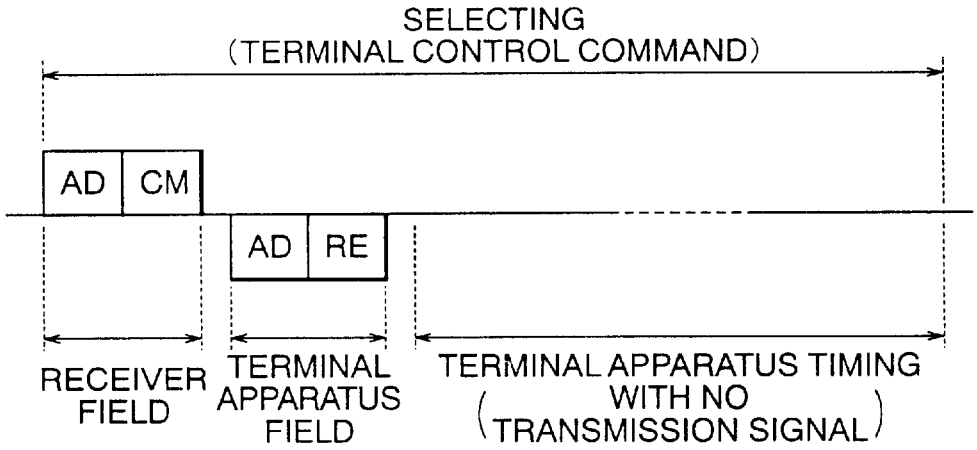
FIG. 8 schematically illustrates a form of an activation signal from a fire receiver to a repeater.

FIG. 8 schematically illustrates a form of an activation signal transmitted from the fire receiver 1 to the repeater.

Activation signal from the fire receiver 1 is transmitted in the form of selecting and not of the point polling. This selecting is a form for causing one terminal apparatus T to directly carry our a control by designating an address.

In a frame, the fire receiver 1 first designates a terminal apparatus T by an address, which is a controlled apparatus to be activated (the position of AD) and combines an activation signal (the position of CM) with it to transmit them. This is a receiver field in terms of timing as in FIG. 7.

In response to this, the terminal apparatus T corresponding to the address returns an its address (the position of AD) and a response signal (the position of RE) as confirmation of contents of receipt. This response signal may be identical with the activation signal as regards the contents of information. However, more specifically, since a primary sum-check code is included in the activation signal and a secondary sum-check code is included in the response signal, contents of the signals are confirmed.

Then, in a frame of the selecting, a terminal apparatus field is short while a frame length is the same as the frame length at the time of the point polling, a blank of transmission is created in its rear part.

Thus, the control unit 24 of the repeater of this embodiment carries out an activation operation of the relay E1 with this state in which a transmission signal does not superimpose over the signal line L as a terminal control timing when it causes the relay E1 to operate.

Therefore, since the control unit 24 can cause the relay E1 to operate when there is no transmission signal in the signal line L and a voltage supplied to the relay E1 is stable, it becomes possible to ensure operation of the relay E1 at the time of receiving an activation signal.

Further, in the selecting, the blank in the rear part of the terminal apparatus field may be short and the terminal control timing may be taken in intervals of transmission signals or the like. Thus, the point polling or the selecting is not always required and the terminal control timing is not upon a transmission form. However, it is preferable to have a wider blank as a timing.

As described above, according to the present invention, a fire receiver includes a LAN interface for connecting with other fire receivers, transmits the fire information over the LAN together with a group number set in advance when a fire sensor issues an alarm, and displays only the fire information of the same group number when the fire receiver receives fire information transmitted from the other fire receivers via the LAN. Thus, there is an effect that, even if a plurality of fire receivers are used in a large building divided into ridge sections, fire information can be shared without causing disorder In addition, if a special group number is set as a group number, all pieces of fire information is displayed when the fire receiver receives fire information transmitted from the other fire receivers via the LAN Therefore, fire receivers which are set as belonging to the special group, share fire information from all of the fire receivers. Thus, there is an effect that centralized monitoring or the like can be easily carried out.

In addition, the fire receiver stores in storing means information on interlocking relation between a fire sensor and a controlled apparatus as well as interlocking relation among the fire sensor and controlled apparatuses of other fire receivers. When the fire sensor issues an alarm, the fire receiver outputs activation information of a controlled apparatus that is to be interlocked and transmits activation information to the controlled apparatuses of the other fire receivers over the LAN based on the information stored in the storing means. Then, when the fire receiver receives activation information transmitted from the other fire receivers via the LAN, the fire receiver activates a controlled apparatus which is designated by the activation information. Thus, there is an effect that interlocking among the controlled apparatuses in response to an issue of an alarm from the fire sensor can be performed among different fire receivers.

In addition, if, before each fire receiver transmits a response signal in response to a fire signal transmitted form another fire receiver, a fire signal is transmitted from yet another fire receiver, one response signal that can be commonly returned is generated and transmitted via the LAN. Thus, in the most efficient case, each fire receiver can respond to all the other fire signals by one response signal, with the result that a number of signals exchanged over the LAN can be reduced. In particular, the greater the number of the connected fire receivers is, the more effective such a configuration becomes. Therefore, the fire receivers need not to carry out complicated processing.

In addition, according to this fire alarm system, when the fire receiver transmits a response signal based on a received fire signal, the fire receiver designates all fire receivers connected to a LAN as destination for transmitting the response signal and data of a fire receiver that transmitted the fire signal is included in the response signal. Thus, if the fire receiver that transmitted the fire signal receives the response signal, the fire receiver can determine whether or not the response signal is transmitted in response to its own fire signal and, if there is a fire receiver that does not respond, can take such measures as transmitting the fire signal again.

In addition, the repeater that controls activation of controlled apparatuses receives an activation signal from the fire receiver via a signal line and causes a relay to operate by controlling means and, then, confirms an operation of a relay contact based on a detection signal of a disconnected state from disconnection monitoring means. Thus there is an effect that confirmation of an operation of the relay contact can be carried out with a simple circuit configuration and small number of components.

Further, when the repeater receives an activation signal from the fire receiver via a signal line and causes a relay to operate by controlling means, the repeater causes the relay to operate at a timing when there is no transmission signal in the signal line. Thus, since the repeater can cause the relay to operate when there is no transmission signal in the signal line and a voltage supplied to the relay is thus stable, there is an effect that it is possible to cause the relay to operate surely at the time of receiving an activation signal.

Thus, it is seen that a fire alarm system is provided. One skilled in the art will appreciate that the present invention can be practiced by other than the preferred embodiments which are presented for the purposes of illustration and not of limitation, and the present invention is limited only by the claims which follow.

What is claimed is:

1. A fire alarm system provided with a fire receiver to which a plurality of fire sensors and controlled apparatuses, which can be controlled in accordance with an issue of an alarm of at least one of said fire sensors, are connected, wherein, upon being connected to a signal line from said fire receiver and receiving an activation signal from said fire receiver, said controlled apparatuses are activated by a repeater for supplying a power to said controlled apparatuses via a control line;

wherein said repeater comprises:

transmitting means that is connected to said signal line and transmits and receives data to and from said fire receiver;

a relay having a relay contact for supplying a power to said controlled apparatuses via said control line when said relay is operating;

a disconnection monitoring means for monitoring disconnection of said control line to detect a disconnected state at the time of disconnection of said control line when said relay is not operating, and detect a disconnected state when said relay is operating as well at the same time; and controlling means that is connected to said transmitting means, said relay and said disconnection monitoring means and controls operations of said repeater, and wherein said controlling means receives a fire signal from said fire receiver via said transmitting means and causes said relay to operate, and then confirms operation of said relay contact based on a detection signal of a disconnected state from said disconnection monitoring means.

2. A fire alarm system provided with a fire receiver to which a plurality of fire sensors and controlled apparatuses, which can be controlled in accordance with an issue of an alarm of at least one of said fire sensors, are connected, wherein said fire receiver comprises:

an interface for connecting to other fire receivers by a LAN;

means for, when said fire sensors issues an alarm, transmitting the fire information together with a group number set in advance over said LAN; and means for, upon receiving fire information transmitted from other fire receivers via said LAN, displaying only the fire information of the same group number.

3. A fire alarm system according to claim 2, wherein said fire receiver further comprises means for, when a special group number is set as a group number, displaying all pieces of fire information upon receiving the fire information transmitted from the other fire receivers via said LAN.

4. A fire alarm system according to claim 2, wherein a special group number can be set as a group number and said fire receiver comprises means for displaying fire information upon receiving the fire information transmitted from fire receivers of the special group number via said LAN.

5. A fire alarm system provided with a fire receiver to which a plurality of fire sensors and controlled apparatuses, which can be controlled in accordance with an issue of an alarm of at least one of said fire sensors, are connected, wherein said fire receiver comprises:

an interface for connecting to other fire receivers by a LAN;

storing means in which information on interlocking relation between said fire sensors and said controlled apparatuses as well as interlocking relation between said fire sensors and controlled apparatuses of other fire receivers is stored;

means for, when said fire sensors issue an alarm, outputting activation information of controlled apparatuses to be interlocked, and transmitting activation information to the controlled apparatuses of the other fire receivers over said LAN at the same time based on the information stored in said storing means; and means for activating controlled apparatuses designated by the activation information upon receiving the activation information transmitted from the other fire receivers via said LAN.

6. A fire alarm system provided with a fire receiver to which a plurality of fire sensors and controlled apparatuses, which can be controlled in accordance with an issue of an alarm of at least one of said fire sensors, are connected, wherein said fire receiver comprises:

an interface for connecting to other fire receivers by a LAN;

storing means in which zone information set for each of said fire sensors and said controlled apparatuses and common zone information to controlled apparatuses of the other fire receivers are stored;

means for, when said fire sensors issue an alarm, outputting activation information of controlled apparatuses to be interlocked in an identical zone, and transmitting the common zone information over said LAN at the same time based on the zone information stored in said storing means; and means for activating controlled apparatuses of an identical common zone based on the zone information stored in said storing means upon receiving the common zone information transmitted from the other fire receivers via said LAN.

7. A fire alarm system provided with a fire receiver to which a plurality of fire sensors and controlled apparatuses, which can be controlled in accordance with an issue of an alarm of at least one of said fire sensors, are connected, wherein said fire receiver comprises:

an interface for connecting to other fire receivers by a LAN; and means for generating and transmitting a response signal via the LAN, which that can commonly respond to a plurality of other fire receivers and transmit the response signal via said LAN, wherein when a first signal is received from another fire receiver and a second signal is received from yet another fire receiver before a response signal is transmitted via the LAN in response to the first signal, said means for generating and transmitting is operable to generate a common response signal and transmit via the LAN the common response signal in order to commonly respond to said another fire receiver and said yet another fire receiver.

8. A fire alarm system according to claim 7, wherein data designating all the fire receivers as destinations of transmission as well as data of information on said destinations of signals are included in said response signal that can commonly respond to the fire receivers.

9. A fire alarm system provided with a fire receiver to which a plurality of fire sensors and controlled apparatuses, which can be controlled in accordance with an issue of an alarm of at least one of said fire sensors, are connected, wherein, upon being connected to a signal line from said fire receiver and receiving an activation signal from said fire receiver, said controlled apparatuses are activated by a repeater for supplying a power to said controlled apparatuses via a control line;

wherein said repeater comprises:

transmitting means that is connected to said signal line and transmits and receives data to and from said fire receiver;

a relay having a relay contact for supplying a power to said controlled apparatuses via said control line when said relay is operating; and controlling means that is connected to said transmitting means and said relay and controls operations of said repeater; and wherein said controlling means receives a fire signal from said fire receiver via said transmitting means and, when causes said relay to operate, causing said relay to operate at a timing when there is no transmission signal in said signal line.

* * * * *